US005138388A

United States Patent [19]

Kamp et al.

[11] Patent Number: 5,138,388

[45] Date of Patent: Aug. 11, 1992

[54] METHOD AND APPARATUS FOR REMOVING UNEXPOSED MARKING PARTICLES WITH MAGNETIC CARRIER PARTICLES

[75] Inventors: Dennis R. Kamp, Spencerport; William Mey, Greece, both of N.Y.

[73] Assignee: Eastman Kodak Company, Rochester, N.Y.

[21] Appl. No.: 632,698

[22] Filed: Dec. 24, 1990

[51] Int. Cl.[5] ..... G03G 15/09

[52] U.S. Cl. ..... 355/251; 118/652; 118/657; 355/253; 355/298; 355/326

[58] Field of Search ..... 355/296, 298, 301, 302, 355/303, 305, 306, 326, 327, 245, 273, 271, 251, 253; 118/652, 656–658; 430/269, 320, 945; 346/157, 76 L

[56] References Cited

U.S. PATENT DOCUMENTS 3,410,203 11/1968 Fischbeck ..... 346/76 L
3,601,484 8/1971 Dybvig et al. ..... 355/327
3,780,214 12/1973 Bestenreiner et al. ..... 358/75
3,920,329 11/1975 Dennie et al. ..... 355/306 X
3,994,725 11/1976 Volkers ..... 355/306 X
4,148,057 4/1979 Jesse ..... 346/76 L
4,571,071 2/1986 Bothner ..... 118/652 X

*Primary Examiner*—A. T. Grimley
*Assistant Examiner*—William J. Royer
*Attorney, Agent, or Firm*—David A. Howley

[57] ABSTRACT

Method and apparatus for the production of a hard copy reproduction of image information. After image-wise exposure of one or more uniform depositions of marking particles in one or more respective image frames on a web, the image frames are cleaned by a novel magnetic brush cleaning apparatus which provides a differential cleaning action, whereby the unexposed marking particles are removed while the exposed marking particles are left in place. The resulting transferable images are then transferred from the image frames to a one or more receivers. After transfer, each receiver is transported to a fuser where the transferred image is fixed.

28 Claims, 3 Drawing Sheets

METHOD AND APPARATUS FOR REMOVING UNEXPOSED MARKING PARTICLES WITH MAGNETIC CARRIER PARTICLES

CROSS-REFERENCE TO RELATED APPLICATION

This application is related to the commonly-assigned, copending U.S. application Ser. No. 07/632,699, filed concurrently herewith, in the names of Carl R. Bothner and Orville C. Rodenberg.

FIELD OF THE INVENTION

This invention relates generally to printing and reproduction apparatus and specifically to image reproduction apparatus and methods providing hard copy reproductions of image information using colored marking particles.

BACKGROUND OF THE INVENTION

Laser based printing systems are known in the art for producing hard copy reproductions of image data. In particular, U.S. Pat. No. 3,410,203, issued in the name of Fischbeck, discloses a non-impact printing apparatus which includes a hologram containing an image of the data to be printed on a printing surface sprinkled with toner. Light energy, such as that derived from a laser, is beamed onto the hologram to project a real image of the data to be printed onto the toner. The suggested laser source is said to comprise a gas laser such as a carbon dioxide ($CO_2$) laser, which is described as particularly suitable because such a laser produces a light beam having a power level of up to one kilowatt. Such a high power level is selected so as to be capable of fusing a variety of toners onto the surface of the paper web surface in the shape of the printed data. Positioned above the paper web is a vacuum sweeper device which includes brushes that gather the excess unfused toner from the printing surface. The gathered toner is then removed by suction.

U.S. Pat. No. 3,780,214, issued in the name of Bestenreiner et al., discloses the production of color prints of multicolored originals on absorbent paper by laser exposure of recording layers, each of which consisting of a differently pigmented material, so that the resulting thermal images are representative of colored portions of the original. The thermal images are applied to a strip of paper so that the differently-colored images of the same original overlie each other. The recording layers can be provided on the paper strip or on discrete expendable or reusable flexible carriers which are transported across the paths of laser beams produced by a $CO_2$ laser.

Similar laser-based printing or copying apparatus are disclosed in U.S. Pat. No. 3,601,484, issued in the name of Dybvig et al., and U.S. Pat. No. 4,148,057, issued in the name of Jesse.

These and other laser-based printing approaches suffer from several drawbacks. One is that the image recording material must be in the form of a unique and expendable carrier, such as the recording layers disclosed in Bestenreiner et al. Thus, the recording material is costly, difficult to use, and not commonly available.

Even if a simpler recording material is used, such as the toner disclosed in Fischbeck, the laser exposure must be quite long in duration, or intense, or both, to ensure adequate fusing of the material to the printing surface. This requirement exists in part due to the relatively high melting point of common toner materials, and in part due to the fact that the preferred toner removal systems, such as the vacuum sweeper device disclosed in Fischbeck, are quite aggressive in their action. Any partially-fused toner, even though it is a part of the image to be retained, will be removed by the preferred cleaning systems disclosed in prior art laser printing systems.

A gas laser is cited as the preferred exposure source because the above-described prior art printing approaches require an exposure source of considerable power output. However, gas lasers are more expensive and not nearly as compact as a semiconductor laser diode. Thus, the above-described prior art laser printing schemes cannot take advantage of the several benefits of semiconductor lasers (and other similarly compact and inexpensive laser sources).

Because prior art methods rely on a step of high power exposure of toner particles, followed by an aggressive cleaning step, the process is less responsive to images having high resolution or minute gradations of image contrast or density. Thus, the prior art laser printing methods described above utilize a recording process that is less sensitive than is desirable.

Further, prior art methods are not so amenable to cyclical operation at high processing speeds (high printing rates), wherein the time available for the exposure and cleaning steps must be reduced in order to make more prints in a given amount of time.

SUMMARY OF THE INVENTION

In accordance with the invention, method and apparatus are provided for producing a hard copy reproduction of image information. Marking particles are deposited in an image frame on an imaging member such that the marking particles are attracted to the imaging member by a predetermined binding force. Selected ones of the marking particles are prepared in an imagewise pattern according to the image information to effect a differential in the binding force acting on selected marking particles with respect to unselected marking particles. A plurality of hard magnetic carrier particles are transported to the image frame and the carrier particles are subjected to alternating polarity magnetic fields to cause the carrier particles to tumble into magnetic alignment in each new field. Relative movement between the plurality of tumbling hard magnetic carrier particles and the imaging member at a predetermined velocity is sufficient to overcome the binding force on the unselected marking particles to remove same from the image frame, without overcoming the binding force on the selected toner particles. The removed marking particles are collected, and a transferable image of selected marking particles is transferred to a receiver.

Preferably, one or more uniform depositions of the marking particles, in one or more respective image frames on a web, are prepared by a laser scanner which provides imagewise exposure of selected particle to energy. After exposure, the image frames on the web are cleaned by the aforementioned differential cleaning action, whereby the unexposed marking particles are removed while the exposed marking particles are left in place. The transferable images are then transferred seriatim from the image frames to a corresponding number of receivers. After transfer, each receiver is transported to a fuser where the transferred image is fixed.

The apparatus and method disclosed herein permits the construction of a reproducing or printing apparatus that provides a reproduction of an original image with great fidelity at high speed. Because the contemplated differential cleaning action is extremely gentle, the imagewise patterns of exposed marking particles need only be lightly fused. That is, there need be only a slight differential in the adhesion of exposed versus unexposed particles. This novel approach enables an exposure step that is lower in intensity, shorter in duration, or both, in comparison to the prior art. The contemplated printing apparatus therefore records images with greater sensitivity and at a higher processing speed that heretofore known.

The invention has substantial and significant use in almost all printing and reproduction applications. Therefore, the invention provides a significant improvement to facsimile systems, laser beam scan copying and printing systems, light emitting diode (LED) copying and printing systems, flash exposure copiers, planographic and other graphics arts or publishing systems, and instrument data recorders or plotters.

BRIEF DESCRIPTION OF THE DRAWINGS

In the detailed description of the preferred embodiment of the invention, reference is made to the accompanying drawings, in which.

Figure 1:
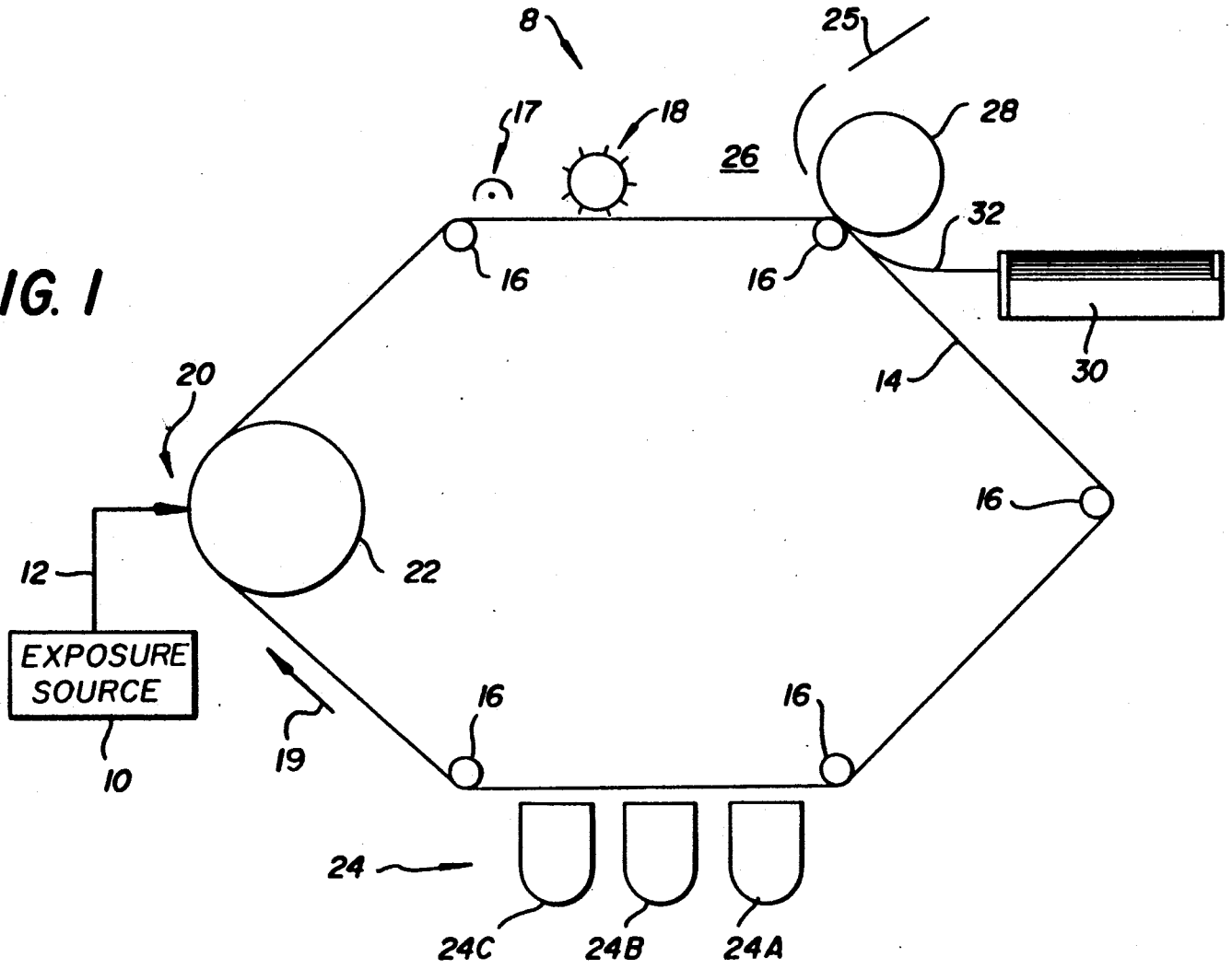
FIG. 1 is a schematic view illustrating the operation of a printing apparatus constructed according to the present invention.

In the drawings and specification to follow it is to be understood that like numeric designations refer to components of like function.

DESCRIPTION OF THE PREFERRED EMBODIMENT

The apparatus of the preferred embodiment will be described in accordance with an electrostatographic recording process. Because electrostatographic reproduction apparatus are well known, the present description will be directed in particular to elements forming part of, or cooperating more directly with, the present invention. Apparatus not specifically shown or described herein are selectable from those known in the prior art. For example, the following describes a web-based printing apparatus for producing hard copy prints on a paper receiver, but other drum-based and planographic printing schemes may be used in carrying out the invention. The invention, for example, is not limited to a methods and apparatus for creating images on a paper receiver, as other media such as planographic plates, metallized or plastic film, etc. may also be used to advantage within the spirit of the invention.

Referring to FIG. 1, a printer apparatus 8 of the electrostatographic type is shown, which employs an exposure source for exposing a dielectric web 14 which is moved in the direction of arrow 19 about its closed loop path. The web 14 is preferably a flexible film such as, for example, Kodak ESTAR film base which is treated to include a conductive layer.

Areas on the web corresponding to image frames receive uniform depositions of marking particles, preferably by one or more respective bias development stations 24A, 24B, 24C. Each development station preferably includes a developer consisting of iron carrier particles and marking particles in the form of pigmented electroscopic toner particles. The toner particles preferably include a thermoplastic binder which will enable them to become adhesive to the web exposed to a predetermined amount of energy. As the developer is brushed over the surface of the web 14, toner particles are uniformly deposited onto each image frame. The toner particles carry an electrostatic charge and thus are attracted to the web due to an electrostatic binding force.

The development stations, shown collectively by reference numeral 24, are preferably of the magnetic brush type. Alternatively, the marking particles may be deposited by other methods known in the art, as long as a uniform deposition is accomplished. In still other alternatives, the marking particles may be in the form of liquid toner, ink, or other colored or opaque particulate matter that may be uniformly applied to the web so as to be retained thereon by a weak binding force.

Areas corresponding to image frames on the web 14 are then selectively exposed to energy supplied by exposure station 20 to increase or supplement the binding force acting on the exposed marking particles. The contemplated exposure pattern corresponds to the image to be reproduced at each exposed image frame. Thus, a differential in the overall pattern of binding force is established in an imagewise pattern within the uniformly-deposited layer of marking particles. The imagewise pattern corresponds to the modulating image information furnished to the exposure source 10 by a suitable data source, such as a computer, optical scanner, and the like.

Preferably, the exposure source 10 is a laser beam scanner that provides a scanning laser light beam to the web 14. In the case of the preferred exposure station 20, the exposure comprises a light beam 12 which moves in the laser scanner's main scanning direction while being modulated by image information that is provided on a dot by dot basis for each scan (or exposure) line. The web 14 is continuously advanced in the web path direction 19.

Alternative energy sources, such as an infared light source, a heated or electrostatically-charged stylus, a high-intensity LED printhead, or another point-like energy radiator may be used in place of the exposure station 20. Still other exposure sources, such as an infared flash exposure from a reflective original, may also be used.

It should also be understood that the exposures of the various image frames are separated either spatially, i.e., apart from each other by a distance on the length of the web; or temporally, whereby the web is rotated a predetermined amount and the same image frame is used to form different image frames in succeeding time periods. Successive image frames can thus represent multiple monochromatic reproductions of a single image, or a single image frame may be used repetitively to accumulate a multicolor reproduction of a single image.

Alternatively, in making multicolor reproductions by, for example, the subtraction color process, a respective set of image frames first receive colored marking particles from respective development stations 24A, 24B, 24C, and so on. The data used to modulate the light from the exposure source 10 is then divided into primary color separation images, each of which modulate the exposure of a successive image frame. Thus, each exposed image frame represents one respective color separation image of a set that comprises a composite multicolor reproduction.

After exposure, the image frames are exposed to a corona charger 17 and then cleaned of unexposed marking particles by a novel magnetic brush cleaning apparatus 18 as will be discussed with respect to FIGS. 3 and 4. The contemplated cleaning apparatus offers a differential cleaning action, whereby the unexposed marking particles are removed while the exposed marking particles are left in place. Because the contemplated cleaning action is also extremely gentle, the prior imagewise exposure of the marking particles need only be sufficient to effect a differential in the adhesion of the exposed versus unexposed particles. Preferably, the differential is provided by lightly fusing the exposed particles to the web 14. This inventive approach enables a prior exposure step that is lower in intensity, shorter in duration, or both, in comparison to the prior art. The contemplated printing apparatus therefore records images with greater sensitivity, at a higher printing rate or processing speed, than is heretofore known.

The image frames of lightly fused marking particles thus comprise one or more transferable images that are transferred seriatim from the web 14 to a corresponding number of receivers 25. Each receiver is advanced in time with the rotating web 14 at the transfer station 26. After transfer, each receiver 25 is removed from the transfer roller and transported to a fuser (not shown) where the toned image is fixed to the receiver. A receiver 25 can be formed from a variety of compositions, including but not limited to paper; flexible, metallized material such as aluminum plate; transparent film stock; or treated film stock such as nickelized ester, photographic film, or photoconductive film.

A monochrome reproduction, or a set of individual monochrome separation images on separate receivers, may be produced as described hereinabove with a single development station 24A, 24B, or 24C. The single monochrome reproduction (using a toner of, for example, black pigment) may be simply an accurate copy or print from an original image. Alternatively, the reproduction may be intended for use as one of the color separations, or masters, of a color composite image and as such may be utilized in a highspeed xeroprinting, lithographic, or other printing system.

The apparatus 8 may alternatively use a plurality of development stations 24A, 24B, 24C, etc., to generate a multicolor reproduction of the original image on a single receiver sheet. To do so, a respective plurality of image frames as described hereinabove are first developed with uniform depositions of colored marking particles from the respective plurality of development stations. Then, modulated exposure patterns form a set of transferable images. After the unexposed marking particles are cleaned from the image frames, the resulting images are then transferred seriatim from their respective image frames to a single receiver. (The receiver is recirculated on or about the transfer roller 28 in synchronization with the approach of each image frame of the web 14.) The set of transferred images forms an accurately superimposed, multicolor composite image on the receiver. Further details regarding the necessary colored marking particle formulations and the synchronization and transfer of color separation images are provided in U.S. Pat. No. 4,777,510, the disclosure of which is incorporated herein by this reference.

Figure 2:
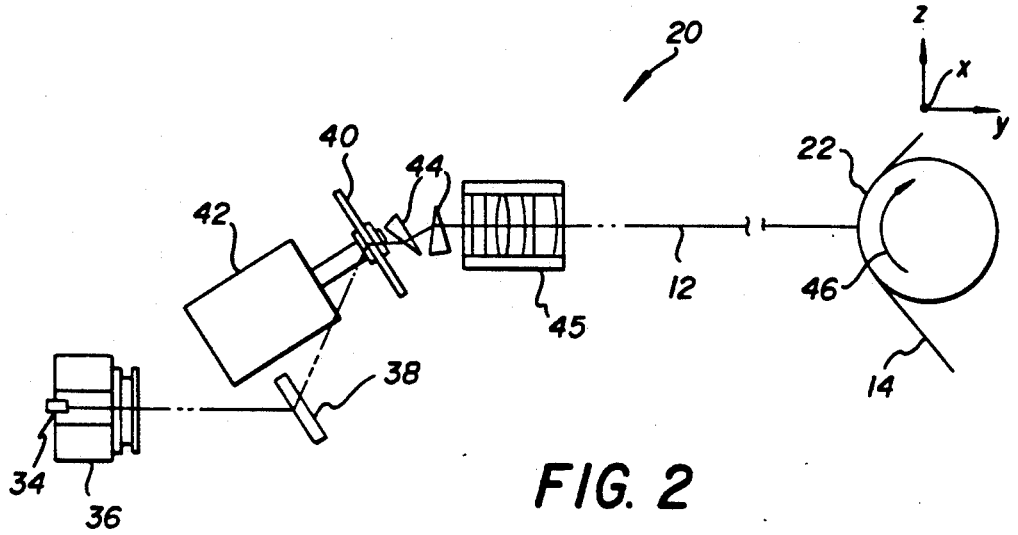
FIG. 2 is a schematic perspective view of the exposure station of the printer shown in FIG. 1.

FIG. 2 is a view illustrating the preferred exposure station 20 in more detail. Actual operating exposure stations may contain other energy-producing exposure devices, or beam deflection means, or more and different types of lenses according to the particular application. The arrangement shown in FIG. 2 is therefore meant to be illustrative of the invention and is simplified in the interest of clarity. For example, the contemplated exposure is provided by a beam of light that is modulated by associated electrical circuitry not shown in FIG. 2.

Imagewise exposure is preferably accomplished by a laser beam scanning apparatus comprising a low power laser beam source 34 for generating a laser beam 12 that passes through beam collimating optics 36. The beam 12 then passes to a stationary diffraction grating 38 which directs the beam to a rotating holographic beam scanner disk 40, which is sometimes referred to as a hologon spinner. Scanner disk or spinner 40 is comprised of a plurality of holographically-produced diffraction grating facets which cause the beam 12 to be scanned in a nominally horizontal direction as the spinner 40 is rotationally driven by a high speed motor 42. The scanning beam 12 then passes through a pair of prisms 44 which serve as anamorphic optics for expanding the beam cross-section dimension in the vertical or cross scan direction. The shaped, scanned beam 12 then passes through an f-Theta lens 45 which serves to focus the scanning beam onto a target represented by rotating drum 22. The horizontal scanning of beam 12 in the x-axis direction on the surface of drum 22 is actually along a line normal to the plane of the drawing, while the vertical or cross-scanning of the beam in the z-axis direction is achieved by rotation of the drum in the direction of arrow 46 to thus generate a two-dimension raster scan.

When the scanner system of FIG. 2 is used to generate a halftone screen image, the laser beam 12 is intensity modulated by a source of digitized data signals (not shown) to generate a two-dimensional array of halftone dots along the horizontal (x-axis) and vertical or cross-scan (z-axis) direction. The size and/or exposure level of each of the dots determines the gray scale, in a black and white image, or the color saturation level in a color separation image. In order to generate different size dots in a raster-scanned screen, each of the dots is composed of a two-dimensional matrix of pixel areas, the number of beam scan lines per dot determining the number of pixels in the cross-scan direction while the number of pixels in the line scan direction are determined by modulation control of the beam by the data signal. For example, a typical image screen may have 150 dots per inch and each dot may be made up of a $12 \times 12$ matrix of pixel areas.

According to FIG. 2, the drum 22 or web 14 may contain indicia means known in the art which are used to determine the location of the web and measure its passage as it rotates around the rollers of the printer 8. Encoder means for determining the location of the web 14 using such indicia, light pulses, or other information generated by such known means enables determination of the exact location of the web anywhere around the path of travel.

Thus, when the image frame on the web 14 is to be written is at a position where the image would be started, the requisite encoder means (not shown) signals that the web 14 is physically in position to receive scanned information from the exposure station 20 to construct the image pattern of differentially-bound marking particles on the web 14. Data is then fed to the laser 34 for the purpose of modulating the laser beam 12 as it scans the web 14. As is known, the physical structure of the line scanner spinner 40, such as its diameter, the number of facets, the grating orientation and pitch of the hologram facets, etc. are selected to achieve desired operational characteristics, such as scan line width, duty cycle, and scan line shape. Considerable advantages are also derived from use of a semiconductor laser diode as the laser source 34. As thus far described, the construction and operation of holographic scanners such as that preferred for use in the exposure station 20 of FIGS. 1 and 2 are well known in the art, and no further discussion is considered necessary for an understanding of the present invention.

Figure 3:
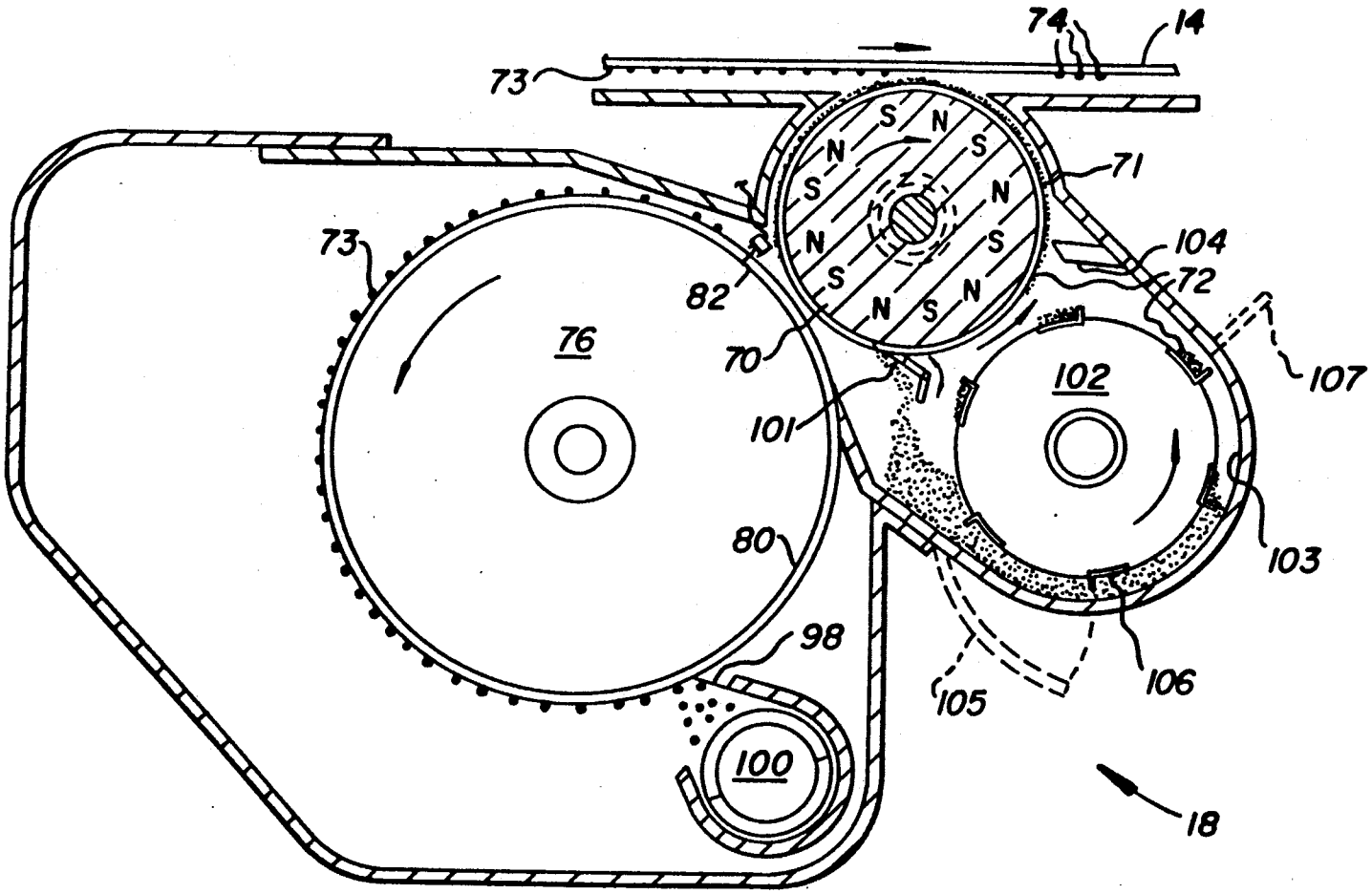
FIG. 3 is a schematic perspective view of the magnetic brush cleaning system of the printer shown in FIG. 1.

With reference now to FIG. 3, a preferred embodiment of the magnetic brush cleaning apparatus 18 will be described. The cleaning apparatus 18 includes a rotatable magnetic core 70 driven in, for example, a clockwise direction. An outer cylindrical shell 71 is driven in a counterclockwise direction. The shell 71 is formed of a non-magnetic material; e.g., chrome, brass, aluminum, copper or stainless steel or a composite comprising a nonconductor, such as fiberglass, plated with one of the aforementioned materials. Conventional means (not shown) are provided for rotating the core and the shell in the requisite counter-current directions. (It is contemplated that the directions of the web 14, the core 70, and shell 71 may all be reversed, depending on the application.) The shell is closely spaced to the web 14 so that a nap formed by aligned hard magnetic carrier particles can fill the small gap or nip region between the web 14 and the shell.

The magnetic core 70 comprises magnetic poles N or S integrated within the periphery of the core and adapted to rotate clockwise as a unit so that the aforementioned nap comprises chains of the hard magnetic carrier particles 72 on the periphery of the shell. By virtue of the changing polarity of the magnetic fields from the core, the carrier particle chains are sufficiently active in a tumbling action to remove substantially all of the unexposed marking particles 73 from the web 14 without substantial removal of the exposed marking particles 74. The core is adapted to rotate in either direction, although preferably it rotates clockwise. The preferred combination of directions of the core and shell is that which causes a flow of tumbling carrier chains in a direction counter-current to the movement of the web 14.

Specifically, it is believed that upon entering the aforementioned nip region, the marking particles 73 and 74 are bombarded by the tumbling chains of carrier particles 72. This bombardment has a significantly tangential component (with respect to the web surface) and the momentum mechanically exceeds the marking particle-to-web contact force of the unexposed marking particles 73, thus allowing the electrostatic field (between the grounded Q-layer of the web 14 and a properly biased surface of the magnetic brush roller) to dominate. The unexposed marking particles migrate away from the web into the cloud of tumbling carrier particles on the shell 71. The exposed particles 74 remain on the web 14 due to their greater adhesion. Triboelectric charging also causes the unexposed marking particles 73 to be attracted to, and adhere to, the rapidly moving carrier particles 72, thus providing for transport of these marking particles out of the nip region.

To aid the removal of the unexposed marking particles from the web, the corona charging station 17 (cf. FIG. 1) located upstream of the cleaning apparatus 18 may be operated to neutralize any charge remaining on the web and thus reduce the binding force of the unexposed marking particles 73 to the web. As a result of this treatment, the marking particles may be biased slightly electrically positive. In addition, a source of bias voltage (not shown) may be coupled to the shell 71 to bias same negatively to electrostatically attract the positively charged marking particles toward the shell.

Means for detoning the steadily-collected marking particles from the carrier particles must be provided. Failure to do this will result in the system's inability to operate in a continuous mode. This detoning process can be accomplished by placing a biased, rotating detone roller 76 in engaged contact with the carrier chains formed on the rotating shell 71. By placing a sufficiently high electrostatic surface potential on the detone roller, an electric field is established between the shell and the detone roller. The resulting electrostatic forces can be controlled so as to strip the collected marking particles from the carrier particles 72 and cause them to deposit on the surface of the detoning roller 76.

For example, the surface of detoning roller 76 may be formed from a non-magnetic conductive material such as aluminum or a composite such as fiberglass that is plated with a metal conductor. One or more electrical brushes 82 are provided as shown and connected to a bias voltage source. The electrical brush 82 engages the surface of the detoning roller 76 to establish a bias thereon such that the potential on the detoning roller causes the collected marking particles to migrate across the gap between the magnetic brush 70 to adhere to the detoning roller 76. The surfaces of the detoning roller and the shell may be rotating either co-current or counter-current to each other. The carrier particles 72 may be recirculated, whereas the unexposed marking particles 73 are subsequently removed from the rotating detoning roller by a contact skive 98 and are transported to a collection site by collection means 100.

Located generally on the opposite side of the detoning roller, means 100 for marking particle collection may include a suitable apparatus for recirculating marking particles back to, for example, one of the development stations 24. Particle collection and recirculating apparatus are well known in the prior art; for example, see U.S. Pat. No. 3,788,454. In lieu of recirculating the marking particles, a container may be provided for collecting marking particles from the chamber.

A skiving blade 101 is also engaged with the magnetic brush shell 71 to remove carrier particles 72 and any marking particles not stripped from the shell 71 by the detoning roller. A metering skive 104 is provided spaced from the periphery of the brush shell 71 to smooth and control the thickness of the carrier particles on the brush. Any marking particles and carrier material removed by skiving blade 101 will fall into a carrier mixture chamber 103 which is continuously mixed by suitable rotating mixing paddles (not shown) formed in the interior of carrier transport wheel 102. The wheel 102 comprises an open structure permitting hard magnetic carrier particles 72 to enter the inside portion thereof and to be worked back and forth by the mixing paddles located on the inside of the wheel 102 so that mixing occurs as the wheel is rotated. The wheel 102 also includes a series of trays 106 located on its periphery to carry hard magnetic carrier particles 72 toward the shell 71. The hard magnetic carrier particles 72 are attracted to the shell 71 and collect thereon for movement toward the nip formed between the shell and the web 14.

Periodically, a carrier purge door 105 may be opened to remove the used carrier particles. A fresh supply of carrier particles may be introduced through a carrier loading door 107. Since any marking particles falling within the carrier mixture chamber can be subsequently picked up by the magnetic brush and eventually reach the collecting chamber, it comprises a potential source of contamination. Therefore, the frequency of change of the carrier particles 72 should be adjusted to keep contamination to an acceptable level.

Figure 4:
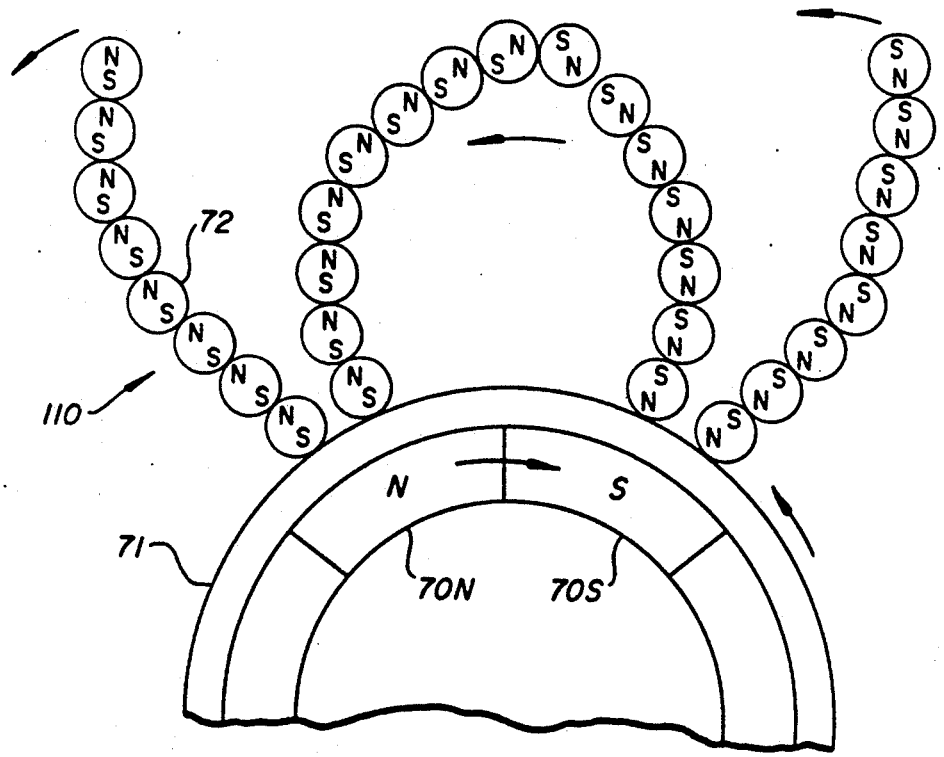
FIG. 4 is a schematic side sectional view of carrier particle movement in the magnetic brush cleaning system shown in FIG. 3.

Turning now to FIG. 4, the characteristics of the preferred composition for the carrier particles 72 used in the cleaning apparatus 18 of FIG. 3 will be described. First, the distinction between soft and hard magnetic materials must be understood. Soft magnetic carrier particles have been the preferred material in conventional magnetic brush systems. Such magnetic carrier is formed of relatively soft magnetic material (e.g. magnetic pure iron, ferrite or a form of $Fe_3O_4$) having a magnetic coercivity, $H_c$, of about 100 oersteds or less. Such soft magnetic materials have been used because they inherently exhibit a low magnetic remanence, $B_R$ (e.g. less than about 5 EMU/gm) and a high induced magnetic moment in the field applied by the typical brush core.

Soft magnetic carrier particles having a low magnetic remanence retain only a small amount of the magnetic moment induced by a magnetic field after being removed from such field. Such materials are readily transported by the rotating brush and are prevented from being picked up by a web during development. However, soft magnetic carrier particles tend to form in undesirable radially-segmented layers that are parallel to the direction of magnet rotation. These layers tend to be more prominent where there is resistance to flow, in areas such as the cleaning zone of a magnetic brush cleaner. Furthermore, and most importantly, carrier particles formed from soft magnetic material will not exhibit the tumbling action that is necessary to, and characteristic of, the cleaning apparatus 18 in the present invention. Soft carrier particles, if used in the contemplated cleaning apparatus, will internally switch their magnetic alignment without physically moving or tumbling.

It is important to note, therefore, that the carrier particles 72 used in the present invention are formed of hard magnetic material. The preferred carrier particles 72 are formed of hard magnetic material that has a high coercivity and resists internal realignment. For the purposes of this description, the term hard magnetic material refers to materials having a coercivity greater than 200 oersteds. The carrier particles used in the cleaning apparatus 18 may be composed substantially the same as the hard magnetic carrier particles used in the development means 24 (cf. FIG. 1). Accordingly, one preferred hard magnetic carrier particle formulation is described in U.S. Pats. Nos. 4,473,029 and 4,546,060, the disclosures of which are hereby incorporated by reference. One advantage of using a single composition of carrier particles in both the development station 24 and the cleaning apparatus 18 is that cross-contamination of carrier particles is avoided.

With reference now to FIG. 4, the desired tumbling action afforded by the preferred hard magnetic carrier particles 72 will be understood. Chains 110 of aligned, hard magnetic particles 72 will form outwardly from the surface of the shell 71. This alignment of the particles is caused by the magnetic fields generated by the magnets 70N and 70S that are located directly below the particulate chains.

As the magnets rotate, the particulate chains 110 try to move in the same direction. If the surface of the shell 71 was frictionless, the chains 110 would follow the rotating magnets. As the shell is not perfectly smooth, friction causes the chains 110 of particles to lag behind the moving magnets. As an opposing polarity magnetic pole N or S approaches the bottom of any one chain, there is a repulsive force between the oncoming pole and the bottom of the chain. At the same time, there is an attractive force between the top of the chain and the oncoming pole. This combined repulsion and attraction causes the chain to tumble. Accordingly, a large number of such particulate chains are forced to tumble as the magnets 70N and 70S in the core rotate.

The magnetic brush cleaning apparatus 18 thereby removes unexposed marking particles from the web by this vigorous tumbling motion of the magnetic carrier particle chains 110 that are transported around the circumference of the shell 71. Each tumble is accompanied by a rapid movement of the particle around the shell in a direction opposite to the relative movement between the shell and core. The observed result is that the carrier particles thereby flow smoothly past the web surface at a rapid rate.

It was our discovery that the contemplated tumbling action of the carrier particle chains appears to remove marking particles from the photoconductor film without incurring the significant abrasion caused by conventional magnetic and non-magnetic brush cleaners. The novel arrangement of carrier particle chains provides for a much shorter radius of carrier particles than the prior art magnetic brush cleaners, and is very much shorter than the brush strands that extend radially from a fiber brush cleaner. Also, the majority of the momentum of the carrier particles in the present invention is tangential to the photoconductor film, to thereby loosen the marking particles without causing the significant impact on the film surface that is common to the prior art. These factors provide for effective, gentle cleaning without causing abrasion of the film. We have also discerned that the contemplated tumbling action provides a high flow rate of carrier particles past the film surface. The improved flow rate contributes to the effectiveness of the gentle cleaning action.

Thus, the carrier particles that enter the region of contact (i.e., the cleaning zone) between the magnetic brush and the web will collide with the exposed marking particles on the web. However, the force of this impact is sufficiently non-aggressive such that the binding forces holding the exposed marking particles to the web are not overcome. Control of the carrier height and flow rate, and thus control of the tangential momentum of the carrier particles, can provide the desired differential of cleaning effected by the cleaning apparatus 18. The contemplated tumbling action of the carrier particle chains can therefore be optimized to remove only the unexposed marking particles from the web without removing any significant amounts of exposed marking particles.

It is contemplated that proper formulation of the carrier particles 72 will contribute to the enhanced cleaning capabilities of the contemplated cleaning apparatus. Preferably, the carrier particles have a small profile in diameters of 30 microns or less, and large surface areas to accommodate higher marking particles concentrations.

Additionally, the hard magnetic material chosen for the contemplated carrier particles must have a coercive force large enough to cause the particles to tumble in an alternating field. Carrier particles are preferred that contain a magnetic material which exhibits a predetermined, minimum level of coercivity when magnetically saturated. More particularly, such a minimum level of saturated coercivity is at least about 200 oersteds.

Carrier particle flow rate in the contemplated cleaning apparatus is dependent not only on coercive force but also on the moment induced by the magnetic poles N or S in the magnetic core 70. In choosing between materials with a known coercive force, the material with a higher induced moment or initial permeability is preferred because such materials have been found to flow at a higher rate. Preferably, one would select materials having an induced magnetic moment of at least 20 EMU/gm when in an external magnetic field of 1000 gauss. Strontium ferrite and barium ferrite are two preferable materials. Also, hard magnetic material may be used that has been exposed to a high external magnetic field and thus is permanently magnetized. Such a material, after being permanently magnetized, will have a higher induced moment at 1000 gauss.

The carrier particles may be binderless carriers (i.e., carrier particles that contain no binder or matrix material) or composite carriers (i.e. carrier particles that contain a plurality of magnetic material particles dispersed in a binder). Both binderless and composite carrier particles containing magnetic materials are coercivity available to comply with the 200 oersteds minimum saturated level so as to be usable as hard magnetic carrier particles.

The apparatus and method disclosed herein permits the construction of a image reproduction or printing apparatus that provides a reproduction of an original image with great fidelity. The image formation method and apparatus as taught according to the present invention is directed not only to the illustrated apparatus 8 but to any similar reproduction apparatus in which the surface of a moving media is first treated with a uniform layer of marking particles, then exposed in a line-by-line exposure to generate one or more image frames for the formation of transferable images, and finally cleaned of unexposed marking particles by the aforementioned improved magnetic brush cleaning apparatus.

It is emphasized that numerous changes may be made in the above-described apparatus and method without departing from the teachings of the invention. It is intended that all of the matter contained in the foregoing description, or shown in the accompanying drawings, shall be interpreted as illustrative rather than limiting.

What is claimed is:

1. A method for producing a hard copy reproduction of image information, comprising the steps of:

depositing a substantially uniform layer of thermoplastic marking particles in an image frame on an imaging member such that the marking particles are attracted to the imaging member by a predetermined binding force;

imagewise exposing selected ones of the marking particles to energy according to image information to be recorded to enhance the binding force between said selected ones of the marking particles and said imaging member;

transporting a plurality of hard magnetic carrier particles to the image frame;

subjecting the plurality of hard magnetic carrier particles to alternating polarity magnetic fields to cause the carrier particles to tumble into magnetic alignment in each new field;

providing relative movement between the plurality of tumbling hard magnetic carrier particles and the imaging member in a manner sufficient to overcome the binding force between the the unselected marking particles and said imaging member to remove said unselected marking particles from the image frame without overcoming the binding force between the selected toner particles and said imaging member to leave behind an image of said selected marking particles on said imaging member.

2. The method of claim 1, wherein the step of imagewise exposing is provided by a scanning laser beam.

3. The method of claim 1, further comprising the steps of:

separating the unselected marking particles from the tumbling hard magnetic carrier particles; and conveying the separated marking particles to a particle containment means.

4. The method of claim 1, wherein the predetermined binding force provided on the marking particles is electrostatic in nature.

5. The method of claim 4, wherein the exposure step at least partially fuses the exposing particles to the imaging member.

6. The method of claim 1, wherein the carrier particles comprise a hard magnetic material exhibiting a coercivity of at least 200 oersteds when magnetically saturated and exhibiting an induced magnetic moment of at least 20 EMU/gm of carrier when in an applied field of 1000 gauss.

7. The method of claim 1, further comprising the step of moving the imaging member at a predetermined velocity substantially equal to a linear velocity of the carrier particle movement.

8. The method of claim 1, wherein the step of depositing the marking particles is carried out with the use of additional ones of the hard magnetic carrier particles in a bias development means.

9. The method of claim 1, further comprising the step of collecting the removed unselected marking particles in a particle containment means.

10. The method of claim 9, further comprising the step of reusing the collected marking particles in the marking particle deposition step.

11. The method of claim 1, further comprising the step of transferring the image to a receiver.

12. A method of producing a hard copy reproduction of image information, comprising the steps of:

bias developing an imaging member to provide a uniform layer of thermoplastic marking particles in at least one image frame thereon, the marking particles being attracted to the imaging member according to a predetermined electrostatic binding force;

scanning the image frame to imagewise expose the marking particles to energy modulated according to image information to mechanically adhere the exposed exposed marking particles to the imaging member;

transporting a plurality of hard magnetic carrier particles to the image frame;

subjecting the plurality of hard magnetic carrier particles to alternating polarity magnetic fields to cause the carrier particles to tumble into magnetic alignment in each new magnetic field;

providing relative movement between the plurality of tumbling hard magnetic carrier particles and the image frame in a manner sufficient to remove unexposed marking particles without removing the exposed marking particles, to provide a transferable image; and transferring the transferable image to a receiver.

13. The method of claim 12, further comprising the steps of:

separating the marking particles from the tumbling hard magnetic carrier particles; and conveying the separated marking particles to a particle containment means.

14. The method of claim 13, further comprising the step of reusing the collected marking particles in the marking particle deposition step.

15. The method of claim 12, wherein the step of bias developing the imaging member is carried out with the use of additional ones of the hard magnetic carrier particles in a bias development means.

16. The method of claim 12, wherein the carrier particles comprise a hard magnetic material exhibiting a coercivity of at least 200 oersteds when magnetically saturated and exhibiting an induced magnetic moment of at least 20 EMU/gm of carrier when in an applied field of 1000 gauss.

17. The method of claim 12, further comprising the step of moving the imaging member at a predetermined velocity substantially equal to a linear velocity of the carrier particle movement.

18. The method of claim 14, further comprising the step of fixing the transferable image to the receiver.

19. Apparatus for producing a hard copy reproduction of image information, comprising:

means for depositing a substantially uniform layer of thermoplastic marking particles on an image frame on an imaging member such that the marking particles are attracted to the imaging member by a predetermined binding force;

means for imagewise exposing selected ones of the marking particles to energy according to image information to be recorded to enhance the binding force between said selected ones of the marking particles and said imaging member;

means for transporting a plurality of hard magnetic carrier particles to the image frame;

means for subjecting the plurality of hard magnetic carrier particles to alternating polarity magnetic fields to cause the carrier particles to tumble into magnetic alignment in each new field;

means for providing relative movement between the plurality of tumbling hard magnetic carrier particles and the imaging member in a manner sufficient to overcome the binding force between unselected marking particles and said imaging member to remove said unselected marking particles from the image frame without overcoming the binding force between the selected toner particles and said imaging member to leave behind an image of said selected marking particles on said imaging member; and means for transferring the image to a receiver.

20. The apparatus of claim 19, wherein the means for imagewise exposing is a laser scanner.

21. The apparatus of claim 20, wherein the laser scanner further comprises a semiconductor laser diode.

22. The apparatus of claim 19, wherein the exposing means includes means for partially fusing the exposed particles to the imaging member.

23. The apparatus of claim 19, further comprising means for separating the unselected marking particles from the tumbling hard magnetic carrier particles; and means for conveying the separated marking particles to toner particle containment means.

24. The apparatus of claim 19, wherein the carrier particles comprise a hard magnetic material exhibiting a coercivity of at least 200 oersteds when magnetically saturated and exhibiting an induced magnetic moment of at least 20 EMU/gm of carrier when in an applied field of 1000 gauss.

25. The apparatus of claim 19, wherein the means for depositing the marking particles is a bias development means.

26. The apparatus of claim 19, further comprising means for fixing the transferable image to the receiver.

27. Apparatus for producing a hard copy reproduction of image information, comprising:

means for bias developing an imaging member to provide a uniform layer of thermoplastic marking particles in at least one image frame thereon, the marking particles being attracted to the imaging member according to a predetermined electrostatic binding force;

means for imagewise exposure of the marking particles according to image information to mechanically adhere the exposed marking particles to the imaging member;

means for removing unexposed marking particles from a surface of the imaging member, comprising:

(a) a supply of hard magnetic carrier particles, (b) a magnetic core having a plurality of magnetic pole portions arranged around the core periphery in alternating magnetic polarity relation, (c) a non-magnetic shell disposed between the core periphery and the surface of the imaging member, and (d) means for providing relative movement between the shell and the magnetic core to move a plurality of carrier particles between the supply and the imaging member and to expose the carrier particles to a succession of magnetic fields emanating from the magnetic core, the carrier particle movement including a tumbling motion of the carrier particles into magnetic alignment in each new field to engage and remove the marking particles without removing the exposed marking particles, to provide a transferable image; and means for transferring the transferable image to a receiver.

28. The apparatus of claim 27, further comprising:

means for separating the marking particles from the tumbling hard magnetic carrier particles; and means for conveying the separated marking particles to a particle containment means.

* * * * *

UNITED STATES PATENT OFFICE

CERTIFICATE OF CORRECTION

Patent No. 5,138,388 Dated August 11, 1992

Inventor(s) Dennis R. Kamp & William Mey

It is certified that error appears in the above-identified patent and that said Letters Patent is hereby corrected as shown below:

Title page, item [54] and col. 1, line 1-3

In the title page: change "METHOD AND APPARATUS FOR REMOVING UNEXPOSED MARKING PARTICLES WITH MAGNETIC CARRIER PARTICLES" to --HIGH SPEED/LOW POWER PRINTER--

Col. 12, Claim 1, line 15, after "between" delete --the the--.

Col. 12, Claim 5, line 34, change "exposure" to --exposing--.

Col. 12, Claim 5, line 35, after "fuses the" change "exposing" to --exposed--.

Col. 13, Claim 12, line 1, delete second occurrence of "exposed".

Signed and Sealed this

First Day of February, 1994

Bruce Lehman

*Attest:*

BRUCE LEHMAN

*Attesting Officer*

*Commissioner of Patents and Trademarks*